US006856309B2

(12) United States Patent
Chang et al.

(10) Patent No.: US 6,856,309 B2
(45) Date of Patent: Feb. 15, 2005

(54) LIQUID CRYSTAL DISPLAY DEVICE

(75) Inventors: Chung-Ok Chang, Kyoungsangbuk-do (KR); Joo-Soo Lim, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 423 days.

(21) Appl. No.: 09/739,822

(22) Filed: Dec. 20, 2000

(65) Prior Publication Data

US 2001/0022570 A1 Sep. 20, 2001

(30) Foreign Application Priority Data

Dec. 27, 1999 (KR) ..... 1999-62985

(51) Int. Cl.[7] ..... G09G 3/36

(52) U.S. Cl. ..... 345/100; 345/205; 345/206; 345/213; 345/211

(58) Field of Search ..... 345/87, 99, 98, 345/100, 204, 88, 92, 211–213, 205–206

(56) References Cited

U.S. PATENT DOCUMENTS 4,922,240 A * 5/1990 Duwaer ..... 340/784
5,418,626 A * 5/1995 Semasa ..... 358/451
5,841,415 A * 11/1998 Kwon et al. ..... 345/90
5,870,075 A * 2/1999 Yamazaki et al. ..... 345/92
6,023,260 A * 2/2000 Higashi ..... 345/100
6,061,246 A * 5/2000 Oh et al. ..... 361/749
6,104,364 A * 8/2000 Hayashi ..... 345/87
6,236,385 B1 * 5/2001 Nomura et al. ..... 345/95
6,320,566 B1 * 11/2001 Go ..... 345/99
6,320,572 B1 * 11/2001 Takabayashi et al. ..... 345/204
6,323,836 B1 * 11/2001 Shin ..... 345/99
6,333,729 B1 * 12/2001 Ha ..... 345/98
6,335,778 B1 * 1/2002 Kubota et al. ..... 349/151
6,344,850 B1 * 2/2002 Okumura et al. ..... 345/204
6,480,230 B1 * 11/2002 Honma ..... 348/443

* cited by examiner

*Primary Examiner*—Richard Hjerpe
*Assistant Examiner*—Kimnhung Nguyen
(74) *Attorney, Agent, or Firm*—Birch, Stewart, Kolasch & Birch, LLP

(57) ABSTRACT

The present invention discloses a liquid crystal display device, including: a liquid crystal panel having a plurality of gate lines arranged in a transverse direction, a plurality of data lines arranged in a longitudinal direction perpendicular to the gate lines, and a plurality of pixels defined by the gate and data lines, the data lines having odd data lines and even data lines; a plurality of gate drive ICs for driving the gate lines and being located on the left hand side of the liquid crystal panel; a plurality of first and second data drive ICs for outputting data signals to the certain pixel through the odd and even data lines, respectively, and being respectively located on the top and bottom portions of the liquid crystal panel, the first data drive ICs driving the odd data lines, the second data ICs driving the even data lines; and a plurality of delay compensating circuits for determining a position of the certain pixel and for delaying the data signal outputted from the first or the second data drive ICs depending on the position of the pixel, whereby all of the data signals from the first and second data drive ICs are outputted to the certain pixel with an equal delay.

8 Claims, 4 Drawing Sheets

LIQUID CRYSTAL DISPLAY DEVICE

CROSS REFERENCE

This application claims the benefit of Korean Patent Application No. 99-62985, filed on Dec. 27, 1999, under 35 U.S.C. § 119, the entirety of which is hereby incorporated by reference.

BACKGROUND OF THE INVENTION

1. Field of the Invention

The present invention relates to a liquid crystal display (LCD) device.

2. Description of Related Art

Active matrix LCD devices, where thin film transistors (TFTs) and pixel electrodes are arranged in the form of a matrix, have been widely used due to a high resolution and an excellent performance of implementing moving images.

FIG. 1 is a cross-sectional view illustrating a liquid crystal panel of a typical active matrix LCD device. As shown in FIG. 1, the liquid crystal panel 20 includes lower and upper substrates 2 and 4 with a liquid crystal layer 10 interposed therebetween. The lower substrate 2 is divided into two regions: a region S; and a region P. TFTs are arranged on the region S as a switching element, and pixel electrodes 14 are arranged on the pixel region P. The upper substrate 4 includes a color filter 8 and a common electrode 12. Through the pixel electrode 14 and the common electrode 12, voltages are applied to the liquid crystal layer 10. In order to prevent a leakage of the liquid crystal, edge portions of the two substrate 2 and 4 are sealed by a sealant 6.

The TFTs receive electrical signals from an external drive IC (integrated circuit) to drive the pixel electrodes 14. Each of the TFTs includes a gate electrode, a source electrode and a drain electrode. The gate electrode extends from a gate line, and the source electrode extends from the data line. The gate and data lines have gate and data pads on their end portion, respectively. The gate and data pads are electrically connected with the external drive IC.

The drive IC is divided into a gate drive IC and a data drive IC. The gate drive IC is electrically connected with the gate pad to control the gate electrode, and the data drive IC is electrically connected with the data pad to control the source electrode.

A technique for connecting the drive IC with the liquid crystal panel 20 includes a COB (chip on board), a TAB (tape automated bonding), and a COG (chip on glass).

Of these, the TAB technique is in most wide use for LCD devices having a high resolution, for example, a resolution of 600×800×3 or 1024×1280×3. The TAB technique is one that the drive IC is mounted on a tape carrier. What the drive IC is mounted on the tape carrier is called a tape carrier package (hereinafter referred to as simply "TCP").

FIG. 2 is a perspective view illustrating a structure of connecting the liquid crystal panel with a TCP using the TAB technique. As shown in FIG. 2, a drive IC 51 is mounted on the TCP 50. The liquid crystal panel 20 is electrically connected with a PCB (printed circuit board) 52 through the TCP 50.

A process for manufacturing the TCP includes an inner lead bonding process, an encapsulating process, and an outer lead bonding process. Through the inner lead bonding process, the tape carrier that is conveyed by a reel-to-reel method is aligned with a chip on a substrate and the two is connected with each other by a heat energy and a pressure. The chip is coated with an epoxy-based resin to protect the chip and the inner leads through the encapsulation process. Outer leads are connected with pads on the PCB through the outer lead bonding process.

FIG. 3 is a plan view illustrating the liquid crystal panel having a dual bank structure according to the conventional art. As shown in FIG. 3, the liquid crystal panel 20 includes an active region 102 on which images are substantially displayed. Gate drive ICs 100G are arranged on the left hand side of the active region 102, data drive ICs 100D are arranged on top and bottom portions of the active region 102. According to a recent tendency toward a high resolution, the dual bank structure in which the data drive ICs are arranged on the top and bottom portions of the liquid crystal panel is in wide use for the LCD devices. In other words, in case of the LCD devices of an SXGA type having a resolution of 1024×1280×3, since the number of the data lines arranged in a longitudinal direction is three times as many as the gate lines arranged in a transverse direction, it is preferable that the dual bank structure is employed.

However, such a dual bank structure has a problem in that spot effect may occur at a position of the active region 102 near the data drive IC 100D.

In further detail, it is assumed that a first drive IC 100D1 drives odd data lines, and a second drive IC 100D2 drives even data lines. As shown in FIGS. 4A and 4B, data signals from the second data drive IC 100D2 has a more distorted wave form at the position A than that from the fist data drive ICs 100D1 does. This is because RC delays of the two lines are different from each other. As a result, a charging time of a pixel charged at the position "A" by data signals, respectively, outputted from the first and second data drive ICs 100D1 and 100D2 becomes different from each other due to an RC delay, leading to a brightness difference between the odd and even data lines. The brightness difference results in spot effect such as a formation of fine vertical lines at the position A.

For the foregoing reasons, there is a need for a LCD device that overcomes spot effect such as a formation of vertical lines and has excellent display characteristics.

SUMMARY OF THE INVENTION

To overcome the problems described above, preferred embodiments of the present invention provide a liquid crystal display (LCD) device having excellent display characteristics.

In order to achieve the above object, the preferred embodiments of the present invention provide a liquid crystal display device, including: a liquid crystal panel having a plurality of gate lines arranged in a transverse direction, a plurality of data lines arranged in a longitudinal direction perpendicular to the gate lines, and a plurality of pixels defined by the gate and data lines, the data lines having odd data lines and even data lines; a plurality of gate drive ICs for driving the gate lines and being located on the left hand side of the liquid crystal panel; a plurality of first and second data drive ICs for outputting data signals to the certain pixel through the odd and even data lines, respectively, and being respectively located on the top and bottom portions of the liquid crystal panel, the first data drive ICs driving the odd data lines, the second data ICs driving the even data lines; and a plurality of delay compensating circuits for determining a position of the certain pixel and for delaying the data signal outputted from the first or the second data drive ICs depending on the position of the pixel, whereby all of the data signals from the first and second data drive ICs are outputted to the certain pixel with an equal delay.

The preferred embodiment of the present invention further provides a liquid crystal display device, including: a liquid crystal panel including gate lines, data lines, and pixels; gate drive ICs for driving the gate lines; data drive ICs for outputting data signals to the certain pixel through the data lines; and delay compensating circuit for compensating a delay of the data signals, whereby all of the data signals have an equal delay regardless of a position of the pixel.

The delay compensating circuit includes: an input terminal for receiving the data signals outputted from the first or the second data drive ICs; a detecting portion for determining a position of the certain pixel; a driving portion for compensating a delay value of the data signal depending on a position of the certain pixel; and an output terminal for outputting a compensated data signal to the certain pixel. The delay compensating circuit is mounted in the first and second data drive ICs.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFFERED EMBODIMENTS

Reference will now be made in detail to preferred embodiments of the present invention, example of which is illustrated in the accompanying drawings.

Figure 1:
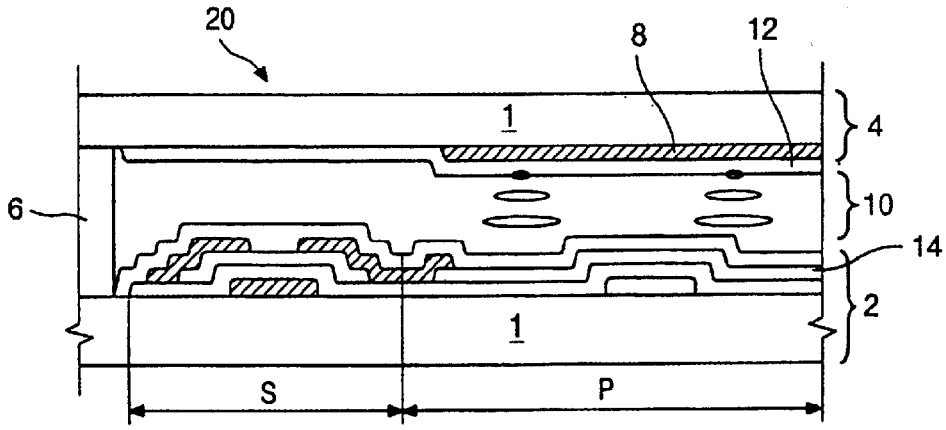
FIG. 1 is a cross-sectional view illustrating a liquid crystal panel of an active matrix LCD device according to a conventional art.
Figure 2:
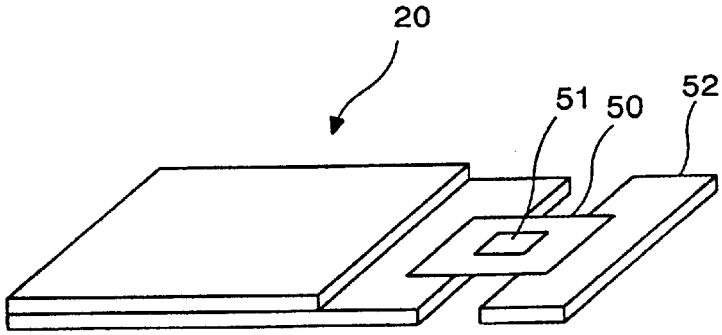
FIG. 2 is a perspective view illustrating a structure of connecting the liquid crystal panel with a TCP using the TAB technique according to the conventional art.
Figure 3:
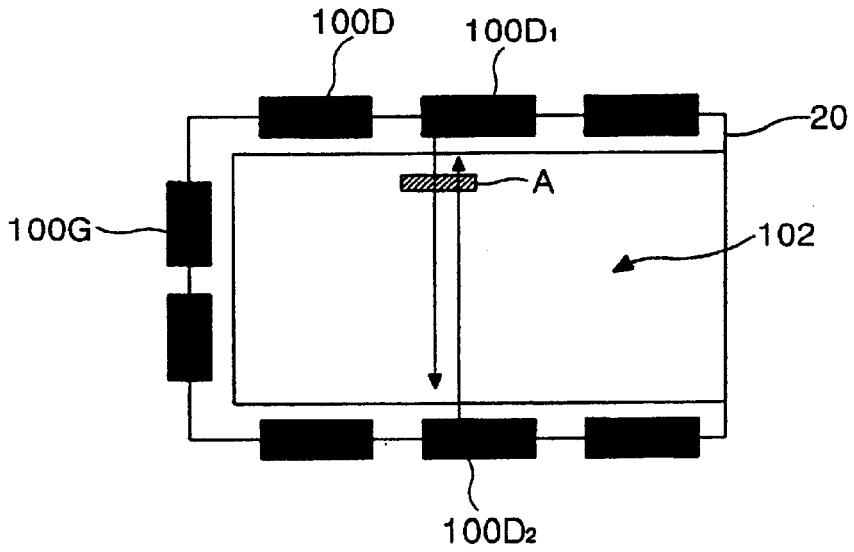
FIG. 3 is a plan view illustrating the liquid crystal panel having a dual bank structure according to the conventional art.
Figure 4A:
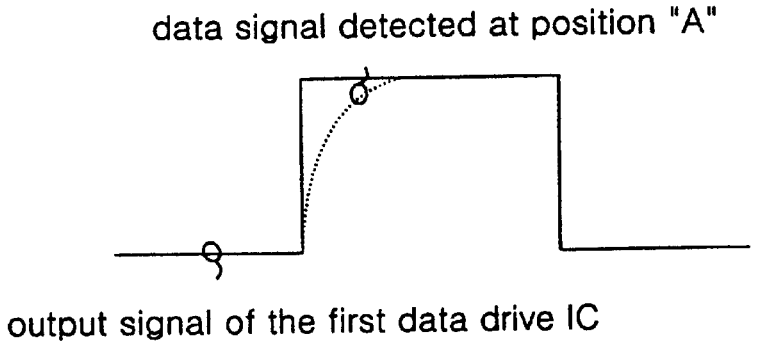
FIGS. 4A and 4B shows wave forms of respective data signals from first and second data drive ICs according to the conventional art.
Figure 4B:
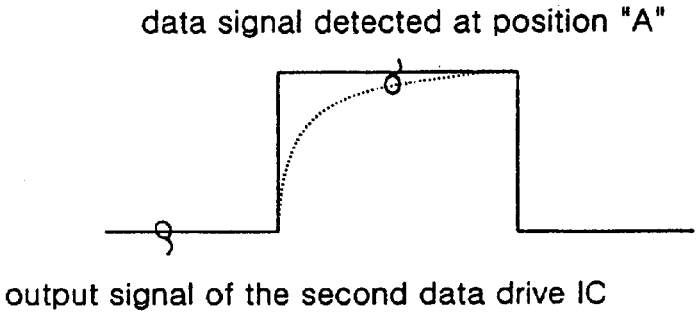
Figure 5:
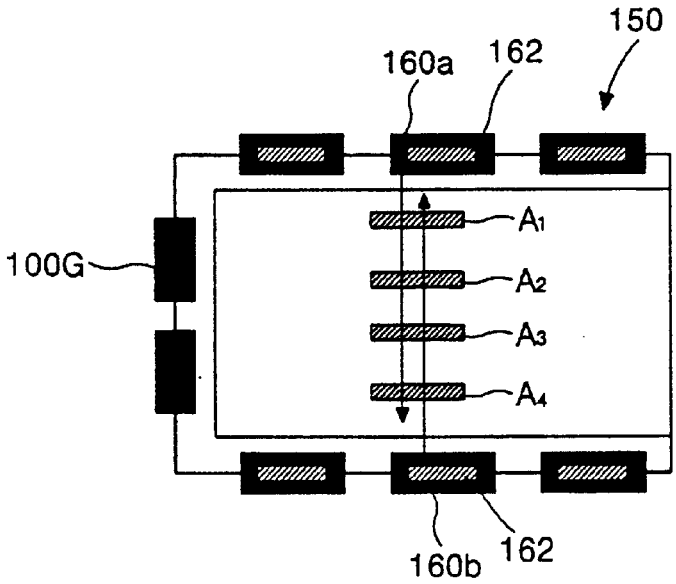
FIG. 5 is a plan view illustrating a liquid crystal display (LCD) device according to a preferred embodiment of the present invention.

FIG. 5 is a plan view illustrating a liquid crystal display (LCD) device according to the preferred embodiment of the present invention. Gate drive IC 100G are arranged on the left hand side of a liquid crystal panel 150, and data drive ICs 160*a* and 160*b* are arranged on top and bottom portions of the liquid crystal panel 150. In other words, first data drive ICs 160*a* are arranged on the top portion of the liquid crystal panel 150 and drive odd data lines. Second data drive ICs 160*b* are arranged on the bottom portion of the liquid crystal panel 150 and drive even data lines. The first and second data drive ICs 160*a* and 160*b* includes a delay compensating circuit 162, respectively. It is possible that the delay compensating circuit 162 is formed independent of the first and second data drive ICs 160*a* and 160*b*. However, the preferred embodiment of the present invention will be explained centering on that the delay compensating circuit 162 is mounted in the first and second data drive ICs 160*a* and 160*b*.

Figure 6:
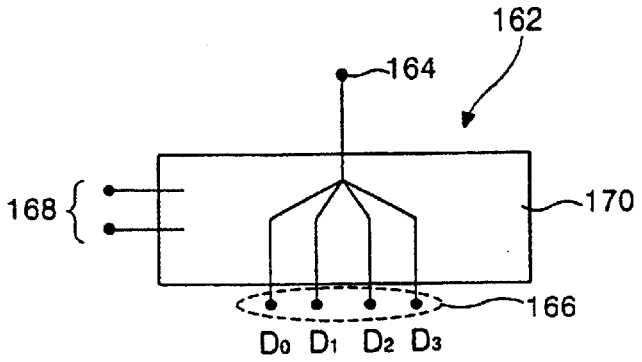
FIG. 6 is a schematic view illustrating a delay compensating circuit according to the preferred embodiment of the present invention.

FIG. 6 is a schematic view illustrating the delay compensating circuit 162. As shown in FIG. 6, the delay compensating circuit 162 includes a data input terminal 164, an output terminal 166, a detecting portion 168, and a driving portion 170. The data input terminal 164 receives data driving signals from the data drive ICs. The driving portion 170 processes data driving signals received through the data input terminal 164. The output terminal 166 outputs processed signals to an active region 200 of the liquid crystal panel and includes signal delay terminals $D_0$, $D_1$, $D_2$, and $D_3$. The detecting portion 168 detects gate signals.

An operation of the delay compensating circuit 162 is explained hereinafter in detail with reference to FIGS. 5 and 6. First, an operation of the first data drive ICs (160*a*) is explained. The first data drive ICs (160*a*) outputs data signals that is applied to the odd data line. The signal delay circuit 162 mounted in the first data drive ICs (160*a*) receives the data signals through the data input terminal 164.

The detecting portion 168 determines a position of a pixel to which the data signals are applied. The position to which the data signal is to be applied corresponds to the position to which gate signal is applied. Gate signal has only one pulse in a frame in view of time. The time that one pulse exists is 1 H (horizontal line period) or time to pass the horizontal gate line of the display screen. The signal applied to the first gate line is called a gate start pulse (Gsp). Gate signals are applied through the gate drive IC(100G) sequentially. The gate signal is applied to the next gate line, after Gsp is first applied with a shift of 1H. Therefore, by connecting the gate driving IC 100G to the detection portion 168 of the first data driving IC 160*a*, the position that the gate signal is applied can be detected and the position of a pixel to which the data signals are applied is determined.

At this time, when the gate drive IC (100G) is located at a location corresponding to the position A, the delay compensating circuit 162 determines a signal delay value corresponding to the position A and delays the data signal outputted from the first data drive ICs 160*a*, so that the delayed data signal is applied to the active region 200 of the liquid crystal panel 150.

If it is assumed that the signal delay value of the position A1 to the position A4 is 3 μs, since a signal delay value of a pixel located at the position A1 is almost "0", the delay compensating circuit 162 delays the data signal from the first data drive ICs 160*a* so that it may have a signal delay value of 3 μs and then outputs a 3 μs delayed data signal to the active region 200 of the liquid crystal panel 150. Further, since a pixel located at the position A4 has a signal delay value of about 3 μs, the delay compensating circuit 162 does not delay the data signal from the first data drive ICs 160*a*, whereby the data signal from the first data drive ICs 160*a* is outputted to the active region 200 of the liquid crystal panel 150 "as is". Further, since a pixel located at the position A3 has a signal delay value of about 2 μs, the delay compensating circuit 162 delay the data signal from the first data drive ICs 160*a* so that it may have a signal delay value of 1, whereby a 1 μs-delayed data signal is outputted to the active region 200 of the liquid crystal panel 150. As a result, all of the pixels, respectively, located to the positions A1, A2, A3, and A4 have an equal signal delay, i.e., 3 μs.

Alternately, a delay compensating circuit mounted in the second data drive ICs 160*b* is operated in the same manner. For example, since a pixel located at the position A1 has a signal delay value of 3 μs, the delay compensating circuit does not delay the data signal from the second data drive ICs 160*a*, whereby the data signal from the second data drive ICs 160*b* is outputted to the active region 200 of the liquid crystal panel 150 "as is".

In other words, when the first and second data drive ICs 160*a* and 160*b* drive a pixel located at the position A1, the first data drive ICs 160*a* outputs a 3 μs -delayed data signal to the active region 200 of the liquid crystal panel 150 through the delay compensating circuit 162, and the second data drive ICs 160*b* outputs the data signal to the active region 200 of the liquid crystal panel 150 through the delay compensating circuit 162 "as is".

Figure 7A:
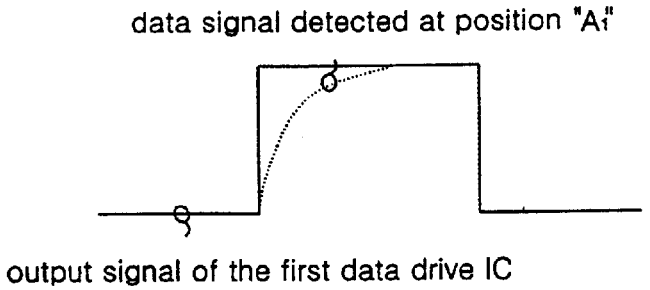
FIGS. 7A and 7B shows wave forms of respective data signals from first and second data drive ICs according to the preferred embodiment of the present invention.
Figure 7B:
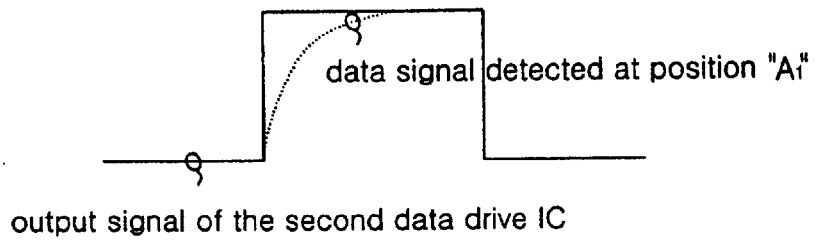

FIGS. 7A and 7B shows output wave forms of the data signal estimated at the position Al by the first and second data drive ICs 160*a* and 160*b*, in which the delay compensating circuit 162. As shown in FIGS. 7A and 7B, the data signals from the first data drive ICs 160*a* and from the second data drive ICs 160*b* are almost same. Therefore, since all of the data signals have an equal RC delay regardless of a position of a pixel, spot effects such as a formation of fine vertical lines resulting from a brightness difference due to a RC delay difference does not occur.

As described herein before, using the LCD device according to the preferred embodiment of the present invention, since the delay compensating circuit makes all of the data signal to have an equal RC delay regardless of a position of a pixel, spot effects such as a formation of fine vertical lines does not occur.

While the invention has been particularly shown and described with reference to first preferred embodiment s thereof, it will be understood by those skilled in the art that the foregoing and other changes in form and details may be made therein without departing from the spirit and scope of the invention.

What is claimed is:

1. A liquid crystal display device, comprising:

a liquid crystal panel having a plurality of gate lines arranged in a transverse direction, a plurality of data lines arranged in a longitudinal direction perpendicular to the gate lines, and a plurality of pixels defined by the gate and data lines, the data lines having odd data lines and even data lines;

a plurality of gate drive ICs for driving the gate lines and being located on the left hand side of the liquid crystal panel;

a plurality of first and second data drive ICs for outputting data signals to a certain pixel through the odd and even data lines, respectively, and being respectively located on the top and bottom portions of the liquid crystal panel, the first data drive ICs driving the odd data lines, the second data ICs driving the even data lines; and a plurality of delay compensating circuits for determining a position of the certain pixel and for delaying the data signal outputted from the first or the second data drive ICs depending on the position of the pixel, whereby all of the data signals from the first and second data drive ICs are outputted to arrive at the certain pixel so as to lessen brightness difference between odd and even data lines.

2. The device of claim 1, wherein the delay compensating circuit includes:

an input terminal for receiving the data signals outputted from the first or the second data drive ICs;

a detecting portion for determining a position of the certain pixel;

a driving portion for compensating a delay value of the data signal depending on a position of the certain pixel; and an output terminal for outputting a compensated data signal to the certain pixel.

3. The device of claim 1, wherein the delay compensating circuit is mounted in the first and second data drive ICs.

4. The liquid crystal display device, comprising:

a liquid crystal panel including a plurality of gate lines arranged in a transverse direction, a plurality of data lines arranged in a longitudinal direction perpendicular to the gate lines, and a plurality of pixels defined by the gate and data lines;

a plurality of gate drive ICs for driving the gate lines and being located on the left hand side of the liquid crystal panel;

a plurality of first and second data drive ICs for outputting data signals to a certain pixel through the data lines, and being respectively located on the top and bottom portions of the liquid crystal panel; and a delay compensating circuit for determining a position of the certain pixel and for compensating for a delay of the data signals output from the first or the second data drive ICs based on a the position of the certain pixel, whereby all of the data signals arrive at the certain pixel so as to lessen brightness difference between odd and even data lines regardless of the position of the certain pixel.

5. The device of claim 4, wherein the delay compensating circuit includes:

an input terminal for receiving the data signals outputted from the first or the second data drive ICs;

a detecting portion for determining a position of the certain pixel;

a driving portion for compensating a delay value of the data signal depending on a position of the certain pixel; and an output terminal for outputting a compensated data signal to the certain pixel.

6. The device of claim 4, wherein the delay compensating circuit is mounted in the first and second data drive ICs.

7. The device of claim 2, wherein the output terminal includes a plurality of signal delay terminals, and one of the plurality of signal delay terminals is selected according to the position of the certain pixel.

8. The device of claim 5, wherein the output terminal includes a plurality of signal delay terminals, and one of the plurality of signal delay terminals is selected according to the position of the certain pixel.

* * * * *